US010724124B2

(12) United States Patent
Bellus et al.

(10) Patent No.: US 10,724,124 B2
(45) Date of Patent: Jul. 28, 2020

(54) STEEL FOR SMALL-CALIBER WEAPON

(71) Applicant: AUBERT & DUVAL, Paris (FR)

(72) Inventors: Jacques J. Bellus, Saint Genest-lerpt (FR); Dominique Thierree, Bellenaves (FR)

(73) Assignee: AUBERT & DUVAL, Paris (FR)

( * ) Notice: Subject to any disclaimer, the term of this patent is extended or adjusted under 35 U.S.C. 154(b) by 70 days.

(21) Appl. No.: 15/580,142

(22) PCT Filed: Jun. 17, 2016

(86) PCT No.: PCT/FR2016/051475
§ 371 (c)(1),
(2) Date: Dec. 6, 2017

(87) PCT Pub. No.: WO2016/203169
PCT Pub. Date: Dec. 22, 2016

(65) Prior Publication Data

US 2018/0142332 A1 May 24, 2018

(30) Foreign Application Priority Data

Jun. 19, 2015 (FR) ..... 1555621

(51) Int. Cl.

| | |
|---|---|
| ***C21D 9/10*** | (2006.01) |
| ***C22C 38/44*** | (2006.01) |
| ***C21D 1/18*** | (2006.01) |
| ***C22C 38/42*** | (2006.01) |
| ***C22C 38/46*** | (2006.01) |
| ***C22C 38/60*** | (2006.01) |
| ***F41A 21/20*** | (2006.01) |
| ***C22C 38/20*** | (2006.01) |
| ***C22C 38/22*** | (2006.01) |
| ***C22C 38/24*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/44* (2013.01); *C21D 1/18* (2013.01); *C21D 9/10* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/42* (2013.01); *C22C 38/46* (2013.01); *C22C 38/60* (2013.01); *F41A 21/20* (2013.01)

(58) Field of Classification Search
CPC .. C21D 1/18; C21D 9/10; C22C 38/00; F41A 21/20
USPC ..... 148/332
See application file for complete search history.

(56) References Cited

U.S. PATENT DOCUMENTS

| | | | | |
|---|---|---|---|---|
| 2,876,095 A | | 3/1959 | Dickerson | |
| 4,622,080 A | | 11/1986 | Wegwerth | |
| 5,458,703 A | * | 10/1995 | Nakai ..... | C21D 1/18 148/503 |
| 2011/0253270 A1 | | 10/2011 | Caliskanoglu et al. | |

FOREIGN PATENT DOCUMENTS

| | | |
|---|---|---|
| AT | 508777 | 4/2011 |
| JP | 2000080444 | 3/2000 |

OTHER PUBLICATIONS

International Search Report and Written Opinion issued in International Application No. PCT/2016/051475 dated Aug. 11, 2016 (9 pages).

* cited by examiner

*Primary Examiner* — Jie Yang
(74) *Attorney, Agent, or Firm* — Hamre, Schumann, Mueller & Larson, P.C.

(57) ABSTRACT

The present invention relates to a steel composition, to the process for manufacturing same, to the steel blank obtained having a hardness of between 46 and 48 HRC and a resilience KV at −40° C. of at least 40 joules, and to the use thereof for manufacturing a pressure appliance component.

19 Claims, No Drawings

STEEL FOR SMALL-CALIBER WEAPON

The present invention relates to a novel steel intended to be used for the manufacture of a tube of a small-calibre weapon, this steel having good malleability and good bursting strength during excessive bulging of the tube under high pressure.

During the use of a weapon, its barrel is subjected to high thermal and mechanical stresses. It is in particular important for the barrel not to burst during the firing of the weapon, which might injure its user. It is thus necessary to provide high-safety and high-quality weapons. To do this, it is necessary to have available steel that has good mechanical characteristics and in particular good bursting strength, even at very low temperature.

Patent applications AT508777 and US 2011/0253270A1 describe a family of steels for manufacturing small-caliber weapon tubes with contents of main elements higher than the contents commonly developed for these applications. Thus, in particular, this steel comprises:

3.6-4.4% Cr, advantageously 3.8-4.2%;
1.2-1.8% Mo, advantageously 1.4-1.6% and
0.42-0.5% V, advantageously 0.44-0.48%.

These documents point out that these high contents of chromium and molybdenum have an advantageous effect on the quenching behaviour of the material and its properties at high temperature. Specifically, according to the comparative example of FIG. 1 of AT508777, the steel V320, which has a much lower content of chromium and molybdenum, does not satisfy the conditions for serving as a barrel tube at and above 390° C. On the other hand, the steel family described in said document makes it possible to obtain the desired mechanical properties with tempering temperatures above 560° C., which thus makes it possible to have high hot mechanical strengths up to temperatures of 500° C. However, the use of a high content of chromium, molybdenum and vanadium is expensive. Moreover, the resilience properties of the steel are not addressed in said document, and patent application AT508777 illustrates in its FIG. 2 a standard resilience value of 30 J at −40° C. Now, it would be advantageous to be able to have available a steel with a better resilience value, in particular of at least 40 J at −40° C., while at the same time reducing the production costs of this steel. Furthermore, these high contents of chromium, molybdenum and vanadium require high quenching treatment temperatures above 940° C., which may give rise to an increase in distortions after quenching and accentuate the risk of decarburization. Japanese patent application JP2000-080444 also describes a steel family for use as a weapon tube. This is a steel with a lower chromium content than in conventional 3% Cr steels but with a higher content of Mo and V. However, the family described can only reach an HRC hardness level limited to 36 HRC. This hardness level is very far from the levels required for high-range applications: 46-48 HRC. In addition, the claimed low-temperature resilience level is low when compared with a standard 3% Cr steel, since the claimed minimum is 16 J for a minimum level of 20 J with 3% Cr.

It would thus be advantageous to be able to have available a steel with a better resilience value, in particular of at least 40 J at −40° C., while at the same time having the hardness required for high-range applications: 46-48 HRC.

Patent U.S. Pat. No. 2,876,095 describes two steel families for application as a weapon tube with an improved service life, by means of adding rare-earth metals during the production of the liquid metal. The chromium and molybdenum contents therein are lower than those of the other steels of the prior art. However, said patent does not describe any particular mechanical properties and in particular does not indicate the hot mechanical strength or the resilience of the steel.

The inventors have noticed, surprisingly, that it is possible to obtain a novel family of steels that is less expensive than those of the prior art, with a resilience value higher than the current steels and in particular of at least 40 J at −40° C., while at the same time having a hardness required for upmarket applications (46-48 HRC). This family of steels may thus be used in the manufacture of an upmarket and thus high-quality small-caliber weapon barrel that is safe for the user, since this family of steels has good malleability and good bursting strength during excessive bulging of the barrel under high pressure without being too expensive. This family is characterized by a low content of Mn combined with a low content of Si, while at the same time avoiding the addition of excessive contents of Cr, Mo and V, which are particularly expensive elements.

The present invention thus relates to a steel composition essentially comprising (advantageously being essentially constituted by, more particularly being constituted by):

Carbon: 0.28-0.35;
Manganese: 0.10-0.60, preferably 0.10-0.20;
Silicon: 0.10-0.20;
Chromium: 2.80-3.40;
Molybdenum: 0.70-1.60, preferably 0.70-1.30;
Vanadium: 0.20-0.50, preferably 0.20-0.40;
Phosphorus: ≤0.005;
Nickel: ≤0.10;
Aluminium: ≤0.025, preferably 0.006-0.025;
Copper: ≤0.10;
Arsenic+Antimony+Tin: <100 ppm;
Sulfur: <10 ppm;
Iron: remainder;

as weight percentages of the total composition, and also the inevitable impurities.

In particular, the inevitable impurities, especially in the form of lead (Pb), bismuth (Bi), magnesium (Mg) and cobalt (Co), are kept as low as possible. These impurities are generally due essentially to the manufacturing process and to the quality of the charging.

The steel composition according to the invention comprises a content of carbon (C) of between 0.28 and 0.35% by weight relative to the total weight of the composition. Specifically, the carbon content ensures that the required hardness (46-48 HRC) is reached with a minimum at 0.28% while at the same time not being detrimental to the impact strength with a maximum at 0.35%. A higher content would not make it possible to obtain good low-temperature impact strength properties, since the high carbon content raises the ductile/fragile transition temperature towards temperatures close to 0° C.

The steel composition according to the invention comprises a content of manganese (Mn) of between 0.10 and 0.60% by weight relative to the total weight of the composition: a minimum content at 0.10% is essential to ensure deoxidation of the liquid metal in order to obtain less than 15 ppm of oxygen on the product. Moreover, the Mn content should not be too high, to obtain a good level of resilience. Advantageously, the Mn content is between 0.10 and 0.30%, more advantageously between 0.10 and 0.20%, by weight relative to the total weight of the composition. Specifically, a low Mn content limited to 0.3% substantially improves the resilience level at −40° C., and a content even more limited to 0.20% even more significantly improves the resilience level at −40° C., all the more so with a suitable tempering time, while at the same time maintaining sufficient mechanical strength. This low Mn content should be accompanied by a low S content in order to avoid any embrittlement by low-melting sulfides.

The steel composition according to the invention comprises a content of silicon (Si) of between 0.10 and 0.20%, by weight relative to the total weight of the composition: specifically, the inventors have realized that the combination of a low Si content and a low Mn content makes it possible to improve the low-temperature resilience value. However, the Si content should not be below 0.10% so as to ensure sufficient deoxidation during the production of the liquid metal.

The steel composition according to the invention comprises a content of chromium (Cr) of between 2.80 and 3.40% by weight relative to the total weight of the composition. This content should be a minimum of 2.80% to ensure the high mechanical properties after tempering at a minimum temperature of 530° C. Since this element is expensive, it is desirable to limit its addition for economic purposes. In addition, it is quite probable that beyond 3.40% of chromium, there is no significant improvement in the mechanical properties. In addition, the limitation to a chromium content of 3.4% makes it possible to perform a quenching dissolution treatment at 920° C. This temperature limitation makes it possible to limit the decarburization and to minimize the quenching distortion. A maximum temperature of 940° C. for the quenching operation is in point of fact desirable so as to limit the enlargement of the austenitic grain, which would have a negative impact on the resilience level at low temperature (−40° C.). Advantageously, the chromium content is between 2.80 and 3.20%, even more advantageously between 2.90 and 3.10% by weight relative to the total weight of the composition.

The steel composition according to the invention comprises a content of molybdenum (Mo) of between 0.70 and 1.60% by weight relative to the total weight of the composition. This content should be a minimum of 0.70% to ensure the high mechanical properties after tempering at a minimum temperature of 530° C. Since this element is expensive, it is desirable to limit its addition for economic purposes. Advantageously, the molybdenum content is between 0.70 and 1.30% by weight relative to the total weight of the composition. Specifically, this range appears to be the best compromise between the mechanical properties and the cost of the steel obtained. Even more advantageously, the molybdenum content is between 0.70 and 1.10%, in particular between 0.80 and 0.90%, by weight relative to the total weight of the composition.

The steel composition according to the invention comprises a content of vanadium (V) of between 0.20 and 0.50% by weight relative to the total weight of the composition. Specifically, a small addition of vanadium makes it possible to control the austenitic grain size. A fine grain size makes it possible to improve the low-temperature resilience behaviour. However, vanadium is also a quite expensive element. Thus, the best compromise between the low-temperature resilience behaviour and the cost of the steel obtained is between 0.20 and 0.50% by weight. Advantageously, the vanadium content is between 0.20 and 0.40%, even more advantageously between 0.20 and 0.30%, by weight relative to the total weight of the composition.

The steel composition according to the invention should not comprise more than 0.025% of aluminium (Al) as weight percentages relative to the total weight of the composition, so as to avoid the formation of alumina which would be detrimental to the desired properties. In an advantageous embodiment, the aluminium content should be greater than 0.006%, in particular than 0.008%, by weight relative to the total weight of the composition, so as to ensure sufficient deoxidation of the metal, the silicon content being limited to 0.200%. Thus, in a particular embodiment, the aluminium content of the composition according to the present invention is between 0.006 and 0.025%, advantageously between 0.008 and 0.025%, by weight relative to the total weight of the composition.

The steel composition according to the present invention has a low content of residuals so as to limit the risk of embrittlement. Thus, a maximum content of phosphorus (P) of 50 ppm, advantageously a maximum of 20 ppm, combined with limited contents of arsenic (As), antimony (Sb) and tin (Sn) with a sum of these three elements of less than 100 ppm makes it possible to obtain a very good strength/toughness compromise. In an advantageous embodiment, the tin content of the steel composition according to the invention is less than 40 ppm. In another advantageous embodiment, the arsenic content of the steel composition according to the invention is less than 40 ppm. In yet another advantageous embodiment, the antimony content of the steel composition according to the invention is less than 20 ppm.

The steel composition according to the invention should not comprise more than 0.10% of nickel (Ni) as weight percentages relative to the total weight of the composition, so as to achieve low $H_2$ contents. In a particular embodiment, the nickel content of the composition according to the present invention is less than or equal to 0.08%.

The steel composition according to the invention must not comprise more than 0.10% of copper (Cu) as weight percentages relative to the total weight of the composition, so as to avoid embrittling the steel. In a particular embodiment, the copper content of the composition according to the invention is less than or equal to 0.05%.

The steel composition according to the invention must not comprise more than 10 ppm of sulfur (S) as weight percentages relative to the total weight of the composition, so as to avoid any embrittlement by low-melting sulfides.

In a particularly advantageous embodiment, the steel composition according to the present invention essentially comprises (advantageously is essentially constituted by, more particularly is constituted by):

Carbon: 0.28-0.35;
Manganese: 0.10-0.20;
Silicon: 0.10-0.20;
Chromium: 2.80-3.40;
Molybdenum: 0.70-1.30;
Vanadium: 0.20-0.40;
Phosphorus: ≤0.005;
Nickel: ≤0.10;
Aluminium: ≤0.025, preferably 0.006-0.025;
Copper: ≤0.10;
Arsenic+Antimony+Tin: <100 ppm;
Sulfur: <10 ppm;
Iron: remainder;

as weight percentages of the total composition, and also the inevitable impurities.

The present invention also relates to a process for manufacturing a steel blank having the steel composition according to the invention, characterized in that it comprises:

a) a step of producing the steel;
b) a step of transforming the steel;
c) a heat treatment of the steel, comprising a tempering treatment at a temperature of at least 530° C., advantageously between 530 and 550° C., for an overall time of between 2 and 6 hours, advantageously for an overall time of 4 hours.

The process according to the present invention thus comprises a step a) of producing the steel. This step thus makes it possible to obtain steel having the composition according to the present invention. Advantageously, the production step a) is performed in an electric arc furnace followed by ladle refining with a degassing treatment (vacuum arc degassing), optionally with a step of electroslag remelting (ESR) or vacuum arc remelting (VAR), or via VIM-VAR or VIM-ESR processes. Production by implementation in an electric arc furnace followed by vacuum arc degassing is the most economical. It makes it possible to obtain a good inclusion state and low dissolved gas contents, in particular low $H_2$ contents. However, an electroslag remelting or vacuum arc remelting treatment gives similar results. These processes are well known to those skilled in the art.

The process according to the present invention also comprises a step b) of transforming the steel obtained in step a). Advantageously, step b) consists of a step of rolling, forging, hammering, stamping or any other means for dressing the steel, and even more advantageously it is a rolling step.

Finally, the process according to the present invention comprises a step c) of heat treatment of the steel comprising a tempering treatment at a temperature of at least 530° C., advantageously between 530 and 550° C., in particular 545° C., for an overall time of between 2 and 6 hours, advantageously for an overall time of 4 hours.

This tempering heat treatment gives the steel blank the final mechanical properties. The microstructure obtained is of tempered martensite type optionally with the presence of a few ferrite patches in very low proportion.

In a particular embodiment, step c) comprises several tempering treatments, in particular several tempering treatments of 2 hours each, the cumulative times of which correspond to the overall time of said step (i.e. advantageously between 2 and 6 hours, more advantageously 4 hours). In an advantageous embodiment, step c) comprises two or three tempering treatments of 2 hours each (overall time of 4 and 6 hours, respectively), in particular two tempering treatments of 2 hours each, which thus corresponds to a tempering treatment having an overall time of 4 hours.

Thus, step c) may consist of a single tempering treatment or of several tempering treatments. However, in a preferred embodiment, it consists of a single tempering treatment.

In yet another particular embodiment, step c) comprises, before the tempering treatment, quenching at a temperature of at least 900° C., advantageously between 900 and 930° C., more advantageously 920° C., in particular for between 10 and 30 minutes, more particularly for 20 minutes. This is a standard treatment that is well known to those skilled in the art.

In another particular embodiment, the heat treatment step c) may be followed by a step d) that consists of a nitridation operation, advantageously at a maximum temperature of 545° C. This is a step that is well known to those skilled in the art.

The present invention also relates to a steel blank that may be obtained via the process according to the invention. This blank is made from steel having the composition according to the present invention and as described above.

By means of the tempering heat treatments of the process according to the invention, the steel blank thus obtained has good malleability and good bursting strength during excessive bulging of the tube under high pressure. It has a good strength/toughness compromise, in particular at low temperature, i.e. a temperature of less than or equal to −40° C.

In one embodiment of the present invention, the steel blank according to the invention has a hardness of between 46 and 48 HRC measured according to standard ASTM E18 or an equivalent standard.

In another embodiment of the present invention, the steel blank according to the invention has a resilience KV at −40° C. of at least 40 joules, advantageously of at least 43 joules, in particular of at least 44 joules, even more particularly of at least 46 joules, the resilience being measured according to standard NF-EN ISO 148-1 or an equivalent standard.

In yet another embodiment of the present invention, the steel blank according to the invention has a mechanical strength Rm at room temperature of between 1500 and 1600 MPa, advantageously between 1510 and 1560 MPa, the mechanical strength being measured according to standard NF EN ISO 6892-1 or an equivalent standard.

The present invention also relates to the use of a steel blank according to the invention or of a steel composition according to the invention for the manufacture of a pressure appliance component, especially such as stoppers or sleeves, especially for a cylinder head, or pressure appliance tubes especially withstanding from 4000 to 10 000 bar, especially including barrel tubes.

Advantageously, the pressure appliance component is a barrel tube, in particular for small-caliber weapons, more particularly for light weapons, even more advantageously for upmarket weapons. The barrels thus obtained are of very good quality, and are very safe for their user.

The invention will be understood more dearly on reading the examples that follow, which are given as a non-limiting guide.

In the examples, unless otherwise mentioned, all the percentages are expressed on a weight basis, the temperature is expressed in degrees Celsius and the pressure is atmospheric pressure.

In addition, the resilience KV is measured according to standard NF-EN ISO 148-1, the mechanical strength Rm is measured according to standard NF EN ISO 6892-1 and the hardness is measured according to standard ASTM E18.

COMPARATIVE EXAMPLE 1—CASTING A (STEEL COMPOSITION WITH SI AND MN CONTENTS OF GREATER THAN 0.2%)

A standard industrial production of 60 tonnes composed of an electric furnace melt comprising the melt operation per se and also a forced dephosphorization operation, followed by a ladle refining operation to finely adjust the chemical elements and to obtain a good level of deoxidation with degassing treatment at the end of production to ensure desulfurization and also low hydrogen contents (the $H_2$ content is typically less than 2 ppm and preferably less than 1.5 ppm, in particular about 1.2 ppm), was used to manufacture a 3% CrMoV steel composition with an Si and Mn content of greater than 0.2%. The chemical composition of the steel composition obtained is reported in Table 1 below:

TABLE 1

| Chemical composition in mass % of casting A except (*) in ppm | | | | | | | | | |
|---|---|---|---|---|---|---|---|---|---|
| C | Mn | Si | Cr | Mo | V | P | Ni | Al | Cu |
| 0.321 | 0.529 | 0.287 | 2.96 | 0.841 | 0.286 | 0.0044 | 0.086 | 0.012 | 0.038 |

| S* | As* | Sb* | Sn* |
|---|---|---|---|
| <10 | 26 | <15 | 37 |

The $O_2$ content is between 7 and 12 ppm.

The casting was rolled into bars.

The mechanical properties obtained after heat treatment at 920° C. for 20 minutes and tempering at 545° C. for 2 hours reach a hardness level of 46 HRC with a relatively fine grain size greater than an ASTM index 10. The resilience KV at 20° C. is 60 joules minimum, the resilience at −40° C. is 37.7 J. The resilience is thus less than 40 J at −40° C.

COMPARATIVE EXAMPLE 2—CASTING B (STEEL COMPOSITION WITH SI AND MN CONTENTS OF GREATER THAN 0.2% AND LOW CONTENTS OF P, AS, SB AND SN)

The casting is obtained via the same process as that of Example 1. The only difference concerns the chemical composition of the steel. It is indicated in Table 2 below.

TABLE 2

| Chemical composition in mass % of casting B except (*) in ppm | | | | | | | | | |
|---|---|---|---|---|---|---|---|---|---|
| C | Mn | Si | Cr | Mo | V | P | Ni | Al | Cu |
| 0.312 | 0.483 | 0.288 | 3 | 0.812 | 0.278 | <0.002 | 0.052 | 0.013 | 0.036 |
| S* | | | As* | | | Sb* | | Sn* | |
| <10 | | | 29 | | | <15 | | 18 | |

The casting was rolled into bars. The resilience values at −40° C. obtained for casting B with a low content of residuals (P, As, Sb and Sn), with heat treatments identical to those performed on casting A, are 38.7 J (mean of 3 values). Thus, a very low value of P, obtained especially by means of a production process particularly followed in an electric furnace by controlled insufflation of oxygen and also in controlling the chemical quality of the metal and non-metal additions, does not make it possible to significantly increase the resilience values at low temperature (−40° C.), and similarly very low values of residuals As, Sb and Sn, the sum of which for casting B is 62 ppm. The resilience is thus less than 40 J at −40° C.

EXAMPLE 1—CASTING C (COMPOSITION ACCORDING TO THE INVENTION)

The casting is obtained via the same process as that of Example 1. The only difference concerns the chemical composition of the steel. It is indicated in Table 3 below and corresponds to a composition according to the invention.

TABLE 3

| Chemical composition in mass % of casting C except (*) in ppm | | | | | | | | | |
|---|---|---|---|---|---|---|---|---|---|
| C | Mn | Si | Cr | Mo | V | P | Ni | Al | Cu |
| 0.312 | 0.18 | 0.115 | 2.98 | 0.842 | 0.278 | 0.002 | 0.058 | 0.015 | 0.035 |
| S* | | | As* | | | Sb* | | Sn* | |
| 9 | | | 24 | | | <15 | | 30 | |

The casting was rolled into bars.

The resilience values at −40° C. obtained for casting C with heat treatments identical to those performed on casting A reach 43.3 J on an average of 6 tests. The hardness obtained remains between 46 and 48 HRC. The austenitic grain size also remains very fine with an ASTM index of greater than or equal to 10.

The increase in resilience is significant compared with castings A and B (Comparative examples 1 and 2) with a gain of the order of 15%.

EXAMPLE 2—CASTING D (COMPOSITION ACCORDING TO THE INVENTION)

The casting is obtained via the same process as that of Example 1. The only difference concerns the chemical composition of the steel. It is indicated in Table 4 below.

TABLE 4

| Chemical composition in mass % of casting D except (*) in ppm | | | | | | | | | |
|---|---|---|---|---|---|---|---|---|---|
| C | Mn | Si | Cr | Mo | V | P | Ni | Al | Cu |
| 0.316 | 0.188 | 0.193 | 2.99 | 0.847 | 0.275 | 0.002 | 0.053 | 0.014 | 0.029 |
| S* | | | As* | | | Sb* | | Sn* | |
| 4 | | | 26 | | | 17 | | 36 | |

The casting was rolled into bars.

The resilience values at −40° C. obtained for casting C with heat treatments identical to those performed on casting A reach 43 J on an average of 6 tests. The hardness obtained is between 46 and 48 HRC.

The increase in resilience is thus also significant compared with castings A and B (Comparative examples 1 and 2) with a gain of the order of 15%. The Si and Mn content (less than 0.20%) thus has a significant impact on the resilience at −40° C.

EXAMPLE 3—CASTING E (COMPOSITION ACCORDING TO THE INVENTION)

The casting is obtained via the same process as that of Example 1. The only difference concerns the chemical composition of the steel. It is indicated in Table 5 below.

TABLE 5

| Chemical composition in mass % of casting E except (*) in ppm | | | | | | | | | |
|---|---|---|---|---|---|---|---|---|---|
| C | Mn | Si | Cr | Mo | V | P | Ni | Al | Cu |
| 0.311 | 0.454 | 0.132 | 3.06 | 0.841 | 0.287 | <0.004 | 0.046 | 0.011 | 0.039 |
| S* | | | As* | | | Sb* | | Sn* | |
| <10 | | | 34 | | | <15 | | 26 | |

The casting was rolled into bars.

For casting E, the resilience values at −40° C. obtained with heat treatments strictly identical to those performed in Comparative examples 1 and 2 and in Examples 1 and 2 on castings A to D show an average of 41.16 J (average of 6 tests). The hardness range obtained is 46-48 HRC.

Thus, if the Mn content of the steel composition is greater than 0.200%, the toughness obtained KV at −40° C. is less than those obtained on castings C and D which have Mn contents <0.200%, while at the same time remaining greater than 40 J.

EXAMPLE 4—IMPACT OF THE TEMPERING TREATMENT ON THE STRENGTH/TOUGHNESS COMPROMISE OF THE COMPOSITION ACCORDING TO THE INVENTION

Casting C (Example 1) after its production and rolling into bars underwent a heat treatment at 920° C. for 20 minutes followed by one or more tempering steps at 545° C. for 2 hours.

The mechanical properties obtained (resilience KV at −40° C. and mechanical strength Rm at room temperature) according to the number of temperings are indicated in Table 6 below.

TABLE 6

KV at −40° C. and Rm at room temperature according to the number of temperings at 545° C. for 2 hours of casting C

| Number of temperings | Rm (MPa) | Average KV (J) |
|---|---|---|
| X1 | 1552 | 42.7 |
| X2 | 1541 | 44.1 |
| X3 | 1530 | 47.3 |
| X4 | 1516 | 46.5 |

As illustrated, the more the number of temperings increases, the more the resilience at −40° C. increases, with the exception of the fourth tempering for which a very slight decrease is observed, while at the same time still having a very good level. The fourth tempering treatment gives interesting results, but the mechanical strength is markedly lower and very close to the 46 HRC minimum desired for this application.

The number of temperings is readily convertible into an equivalent treatment time for a single tempering operation at 545° C. Table 7 below shows that a single tempering treatment with a time corresponding to 2 tempering treatments at 545° C. or 3 tempering treatments at 545° C. gives very similar results.

TABLE 7

KV at −40° C. and Rm as a function of the tempering time at 545° C. of casting C

| Tempering time | Rm (MPa) | Average KV (J) |
|---|---|---|
| 2 hours | 1552 | 42.7 |
| 4 hours | 1549 | 45.3 |
| 6 hours | 1533 | 47.5 |

Adaptation of the number of temperings or its equivalent in tempering time makes it possible to significantly increase the level of resilience. The gain relative to casting A treated under the standard conditions is 25% to 30% approximately for casting C.

It should be noted that this improvement results from the combination of a low Si content and a low Mn content (less than 0.2%) with a 3% Cr—Mo—V base as shown in Table 8 below.

TABLE 8

Influence of the number of temperings at 545° C. for 2 hours according to the chemical composition on Rm and KV at −40° C.

| | Number of temperings | Rm (MPa) | Average KV at −40° C. (J) |
|---|---|---|---|
| Casting C (Example 1) | X1 | 1559 | 43.3 |
| | X2 | 1546 | 46 |
| | X3 | 1543 | 47.7 |
| | X4 | 1516 | 46.5 |
| Casting E (Example 3) | X1 | 1532 | 41 |
| | X2 | 1524 | 43.7 |
| | X3 | 1511 | 44 |
| | X4 | 1516 | 44.7 |
| Casting A (Comparative example 1) | X1 | 1542 | 37.7 |
| | X2 | 1532 | 39 |
| | X3 | 1528 | 35.7 |
| | X4 | 1516 | 34.7 |

Only casting C makes it possible to pass to a resilience level greater than 45 J with a suitable number of temperings at 545° C. The low content of silicon alone (less than 0.2%: casting E) makes it possible to increase the resilience level to approximately 44 J. It should be noted that in the case of the steel with a high content of Si and Mn (casting A), the number of temperings does not have any influence on the resilience level. The average resilience value even has a tendency to decrease significantly after the third tempering treatment.

EXAMPLE 5—IMPACT OF THE QUENCHING TEMPERATURE OF THE HEAT TREATMENT ON A CASTING F ACCORDING TO THE INVENTION: 920° C. VS 960° C.

Casting F is obtained via the same process as that of Example 1. The only difference concerns the chemical composition of the steel. It is indicated in Table 9 below.

TABLE 9

Chemical composition in mass % of casting F

| C | Mn | Si | Cr | Mo | V |
|---|---|---|---|---|---|
| 0.30 | 0.19 | 0.19 | 3.1 | 1.1 | 0.28 |

The resilience value at −40° C. obtained for casting F with a heat treatment with quenching at 920° C. and a single tempering of 2 hours at 545° C. reaches 42 J; whereas, for the same casting F, a heat treatment with quenching at 960° C. and a single tempering of 2 hours at 545° C. leads to a resilience value at −40° C. of 27 J.

A high quenching temperature, at 960° C., thus degrades the resilience of the steel.

The invention claimed is:

1. A steel composition consisting essentially of:

carbon: 0.28-0.35;
manganese: 0.10-0.60;
silicon: 0.10-0.20;
chromium: 2.80-3.40;
molybdenum: 0.70-1.60;
Vanadium: 0.20-0.50;
phosphorus: ≤0.005;
nickel: ≤0.10;
aluminium: ≤0.025;
copper: ≤0.10;
arsenic+antimony+tin: <100 ppm;
sulfur: <10 ppm;
iron: remainder;

as weight percentages of the total composition, and also inevitable impurities, wherein the steel composition when heat treated has a resilience KV at −40° C. of at least 40 joules.

2. The steel composition according to claim 1, consisting essentially of:

carbon: 0.28-0.35;
manganese: 0.10-0.20;
silicon: 0.10-0.20;
chromium: 2.80-3.40;
molybdenum: 0.70-1.30;
vanadium: 0.20-0.40;
phosphorus: ≤0.005;
nickel: ≤0.10;
aluminium: ≤0.025;
copper: ≤0.10;
arsenic+antimony+tin: <100 ppm;
sulfur: <10 ppm;
iron: remainder;
as weight percentages of the total composition, and also the inevitable impurities.

3. The steel composition according to claim 1, wherein the molybdenum content is between 0.7 and 1.1, as weight percentages of the total composition.

4. The steel composition according to claim 1, wherein the aluminium content is between 0.006 and 0.025, as a weight percentage of the total composition.

5. A pressure appliance component made from the steel composition according to claim 1.

6. The pressure appliance component according to claim 5, wherein the pressure appliance component is a barrel tube.

7. The pressure appliance component according to claim 6, wherein the barrel tube is for a small-calibre weapon.

8. A steel blank formed from the steel composition of claim 1, wherein the steel blank has the resilience KV at −40° C. of at least 40 joules.

9. The steel blank according to claim 8, wherein the steel blank has a mechanical strength Rm of between 1500 and 1600 MPa.

10. The steel blank according to claim 8, wherein the steel blank has a hardness at or between 46 and 48 HRC.

11. A process for manufacturing a steel blank having the composition according to claim 1, the process comprising:

a) a step of producing the steel;
b) a step of transforming the steel;
c) a heat treatment of the steel comprising a tempering treatment at a temperature of at least 530° C., for an overall time of between 2 and 6 hours.

12. The process according to claim 11, wherein step c) comprises several tempering treatments, the cumulative times of which correspond to the overall time of said step.

13. The process according to claim 12, wherein step c) comprises two tempering treatments of 2 hours each.

14. The process according to claim 11, wherein step c) comprises, before the tempering treatment, quenching at a temperature of at least 900° C.

15. The process according to claim 14, wherein the quenching is at a temperature of between 900 and 930° C.

16. The process according to claim 11, wherein step b) consists of a rolling step.

17. The process according to claim 11, wherein the production step a) is performed in an electric arc furnace followed by vacuum arc degassing, or via VIM-VAR or VIM-ESR processes.

18. The process according to claim 17, wherein the production step a) is performed in an electric arc furnace followed by vacuum arc degassing with a step of electroslag remelting (ESR) or vacuum arc remelting (VAR).

19. The process according to claim 11, wherein the tempering treatment of step c) is at a temperature of between 530 and 550° C. for an overall time of 4 hours.

* * * * *